United States Patent [19]

Ohe et al.

[11] Patent Number: 4,618,474

[45] Date of Patent: Oct. 21, 1986

[54] CO-BASE HEAT RESISTANT ALLOY

[75] Inventors: Junya Ohe, Urawa; Saburo Wakita, Omiya; Kiichi Yamatsuta; Shoji Goto, both of Kanagawa; Yukinori Kutsukake, Tokyo; Masuo Sugizaki, Yokohama, all of Japan

[73] Assignees: Asahi Fiber Glass Company, Limited; Asahi Glass Company, Limited; Mitsubishi Kinzoku Kabushiki Kaisha, all of Tokyo, Japan

[21] Appl. No.: 694,791

[22] Filed: Jan. 25, 1985

[51] Int. Cl.[4] ..... C22C 19/07

[52] U.S. Cl. ..... 420/436; 420/437; 420/440; 420/585; 420/586; 420/588

[58] Field of Search ..... 420/436, 437, 440, 585, 420/586, 588; 148/408, 419, 425, 442

[56] References Cited

U.S. PATENT DOCUMENTS

| | | | |
|---|---|---|---|
| 3,549,356 | 12/1970 | Sims et al. | 420/436 |
| 3,881,918 | 5/1975 | Costin et al. | 420/585 |
| 3,933,484 | 1/1976 | Costin | 420/588 |
| 3,980,473 | 9/1976 | Costin | 420/588 |
| 3,984,240 | 10/1976 | Costin | 420/588 |
| 4,353,742 | 10/1982 | Crook | 420/585 |
| 4,465,530 | 8/1984 | Kagohara et al. | 148/410 |

*Primary Examiner*—R. Dean

*Attorney, Agent, or Firm*—Oblon, Fisher, Spivak, McClelland & Maier

[57] ABSTRACT

A Co-base heat resistant alloy consisting essentially of:

from 0.05 to 1% by weight of C, from 0.05 to 2% by weight of one or both of Si and Mn, from 31 to 40% by weight of Cr, from 5 to 15% by weight of Ni, from 2 to 12% by weight of one or both of W and Mo and from 0.1 to 5% by weight of Hf, and optionally further containing:

from 0.01 to 1% by weight of one or both of Al and Y, from 0.5 to 3% by weight of one or both of Ta and Nb and from 0.005 to 0.1% by weight of one or both of B and Zr, the rest being Co and unavoidable impurities.

8 Claims, No Drawings

CO-BASE HEAT RESISTANT ALLOY

BACKGROUND OF THE INVENTION

1. Field of the Invention

The present invention relates to a Co-base heat resistant alloy. More particularly, it relates to a Co-base heat resistant alloy which has excellent high temperature oxidation resistance and high temperature strength and particularly excellent corrosion resistance against molten glass (hereinafter referred to simply as "molten glass resistance"), and which is thus particularly useful as a corrosion resistant material for an apparatus or an equipment for treating molten glass, such as a spinner for forming glass fibers. For the convenience of description of the present invention, a reference is made to a spinner for forming glass fibers, although the present invention is not limited to such a particular use and is generally applicable for the treatment of molten glass.

2. Description of Prior Art

Glass fibers are usually formed by feeding into a spinner molten glass heated to a temperature of about 1000° C. and rotating the spinner at a high speed of about 1700 rpm whereby the molten glass is centrifugally jetted from a plurality of perforations radially provided along the side wall of the spinner. Accordingly, the spinner is required to have high temperature oxidation resistance, high temperature strength, and inter alia high temperature creep rupture strength and molten glass resistance.

Co-base heat resistant alloys have been proposed as alloys useful for the production of spinners for forming glass fibers, e.g. in U.S. Pat. Nos. 3,881,918, 3,933,484, 3,980,473 and 3,984,240. However, such a conventional Co-base heat resistant alloy does not have adequate molten glass resistance, and the useful life of the spinner made thereof used to be relatively short as the perforations in the side wall of the spinner became to have a diameter exceeding the allowable limit in a relatively short period of time.

SUMMARY OF THE INVENTION

Under the circumstances, the present inventors have conducted extensive researches to develop an alloy having high temperature oxidation resistance, high temperature strength (i.e. high temperature creep rupture strength) and molten glass resistance (i.e. corrosion resistance against molten glass). As a result, it has been found that a Co-base alloy consisting essentially of:

from 0.05 to 1% by weight of C,
from 0.05 to 2% by weight of one or both of Si and Mn,
from 31 to 40% by weight of Cr,
from 5 to 15% by weight of Ni,
from 2 to 12% by weight of one or both of W and Mo and
from 0.1 to 5% by weight of Hf, and optionally further containing:
from 0.01 to 1% by weight of one or both of Al and Y,
from 0.5 to 3% by weight of one or both of Ta and Nb and
from 0.005 to 0.1% by weight of one or both of B and Zr,
the rest being Co and unavoidable impurities, has not only excellent high temperature oxidation resistance and high temperature strength, but also excellent molten glass resistance, and when this Co-base heat resistant alloy is employed for the production of a spinner for forming glass fibers, it is possible to obtain a spinner which is capable of providing excellent performance for a long period of time. The present invention has been accomplished on the basis of such discoveries.

DETAILED DESCRIPTION OF THE INVENTION

The above-mentioned ranges of the respective components of the alloy according to the present invention will be discussed.

(a) C

The C component not only constitutes a solid solution in the base material but also forms carbides together with Cr, W, Mo and Hf, and optionally further with Ta, Nb or the like, and thus it serves to strengthen the crystal grains and grain boundaries and functions to improve the high temperature strength and further to improve the weldability and castability of the alloy. However, if the content is less than 0.05% by weight, no adequate effectiveness for the above-mentioned functions will be obtainable. On the other hand, if the content exceeds 1% by weight, the toughness tends to deteriorate. Accordingly, the content should be from 0.05 to 1% by weight.

(b) Si and Mn

The Si and Mn components improve the castability of the alloy and have a function for deoxidation. Therefore, at least one of these components is essential for the melting and casting of the alloy. However, if the content is less than 0.05% by weight, no adequate effectiveness for such functions is obtainable. On the other hand, if the content exceeds 2% by weight, no further improvement in the deoxidizing effect is obtainable and the alloy properties tend to deteriorate. Thus, the content should be from 0.05 to 2% by weight.

(c) Cr

The Cr component is an austenite-constituting component which is essential to obtain excellent high temperature oxidation resistance. If the content is less than 31% by weight, no adequate effectiveness for the excellent high temperature oxidation resistance is obtainable. On the other hand, if the content exceeds 40% by weight, the high temperature strength and toughness tend to deteriorate abruptly. Thus, the content should be from 31 to 40% by weight.

(d) Ni

The Ni component improves the high temperature strength in the presence of Cr, and further constitutes and stabilizes the austenite base material. It also has a function to improve the processability. However, if the content is less than 5% by weight, no adequate effectiveness for the above-mentioned functions is obtainable. On the other hand, if the content exceeds 15% by weight, no further improvement in the effectiveness is obtainable and the high temperature strength tends to deteriorate. Thus, the content should be from 5 to 15% by weight.

(e) W and Mo

These components form, together with C, MC-type carbides i.e. high melting point carbides, while suppressing the formation of low melting point carbides of $M_7C_3$-type or $M_{23}C_6$-type. Thus, it serves to improve the high temperature strength, and also constitutes a solid solution in the austenite base material and thus serves to strengthen the austenite base material. However, if the content is less than 2% by weight, no adequate effectiveness for the above-mentioned functions is obtainable. On the other hand, if the content exceeds 12% by weight, the high temperature oxidation resistance tends to deteriorate abruptly, and an intermetallic compound such as a $\sigma$-phase attributable to the deterioration of the toughness is likely to form. Thus, the content should be from 2 to 12% by weight.

Hf

The Hf component forms a MC-type primary carbide i.e. a high melting point carbide, without forming a MC-type or $M_7C_3$-type eutectic carbide, and thus serves to improve the high temperature oxidation resistance and high temperature strength. Further, it serves to improve the molten glass resistance remarkably. However, if the content is less than 0.1% by weight, no adequate effectiveness for the above-mentioned functions is obtainable. On the other hand, if the content exceeds 5% by weight, no further improvement of the effectiveness is obtainable. Thus, the content should be from 0.1 to 5% by weight.

Al and Y

The Al and Y components have functions to improve the high temperature oxidation resistance, and to improve the resistance to exfoliation of scales. However, if the amount is less than 0.01% by weight, no adequate effectiveness for the above-mentioned functions is obtainable. On the other hand, if the content exceeds 1% by weight, the castability and processability tend to deteriorate. Therefore, the content is preferably from 0.01 to 1% by weight.

(h) Ta and Nb

These components form MC-type primary complex carbides i.e. high melting point carbides, in the presence of Hf, and thus serve to further improve the high temperature oxidation resistance and high temperature strength and yet have a function to improve the molten glass resistance. Accordingly, these components may optionally be incorporated particularly when these properties are required. However, if the content is less than 0.5% by weight, no adequate effectivenss for the above-mentioned functions is obtainable. On the other hand, if the content exceeds 3% by weight, no further improvement in the effectiveness is obtainable. Therefore, the content is preferably from 0.5 to 3%.

(i) B and Zr

These components have a function to strengthen the crystal grain boundaries and thus to remarkably improve the high temperature strength of the alloy. Accordingly, they may optionally be incorporated when such a function is desired. However, if the content is less than 0.005% by weight, no adequate effectiveness for the improvement of the high temperature strength is obtainable. On the other hand, if the content exceeds 0.1% by weight, the toughness tends to deteriorate. Thus, the content is preferably from 0.005 to 0.1% by weight.

Among the unavoidable impurities contained in the Co-base heat resistant alloy of this invention, Fe may be contained in an amount of up to 3% without bringing about any deterioration of the properties of the alloy. Accordingly, from the economical reason, Fe may positively be incorporated in an amount of up to 3% by weight.

Now, the present invention will be described in further detail with reference to Examples. However, it should be understood that the present invention is by no means restricted by these specific Examples.

EXAMPLE 1

Co-base heat resistant alloys 1 to 36 of the present invention and comparative Co-base heat resistant alloys 1 to 11 having the respective compositions as identified in Table 1, were prepared by a usual melting method. By means of a lost wax precision casting method, each alloy was cast into a test piece material having a dimension of the outer diameter of the portion to be tested being 7 mm, the length of the portion to be tested being 50 mm, the outer diameter of the chuck portion being 25 mm, and the total length being 90 mm. Then, for the purpose of evaluating the high temperature strength, a creep rupture test piece having a diameter of 6 mm and a length of 30 mm provided with chuck portions, was prepared by milling the above-mentioned test piece material. The test piece thus prepared was subjected to a creep rupture test at a temperature of 1100° C. under an exerted load stress of 3.5 kg/mm$^2$ in an atmosphere of air, whereby the mean rupture life was determined.

A test piece having a diameter of 10 mm and a height of 10 mm was cut out from the chuck portion of the test piece subjected to the above-mentioned creep rupture test. This test piece was subjected to a high temperature oxidation resistance test in which the test piece was maintained at a temperature of 1100° C. for 10 hours in an atmospheric air, followed by scale removal, for one cycle operation, and the weight reduction due to oxidation was measured after repeating the operation for ten cycles.

Further, for the purpose of evaluating the molten glass resistance, a test piece with a dip portion having a diameter of 6 mm and a length of 16 mm was cut out from the above-mentioned test piece material. This test piece was subjected to a molten glass dipping test in which the test piece was immersed in molten glass at a temperature of 1120° C. for 120 hours, and the weight reduction due to corrosion was measured after the test.

The results of the above tests are shown in Table 2.

TABLE 1

| Alloys | Proportions of the components (% by weight) | | | | | | | | | | | | | | |
|---|---|---|---|---|---|---|---|---|---|---|---|---|---|---|---|
| | C | Si | Mn | Cr | Ni | W | Mo | Hf | Al | Y | Ta | Nb | B | Zr | Co + impurities |
| Co-base heat resistant alloys of the present invention | | | | | | | | | | | | | | | |
| 1 | 0.07 | 0.58 | 0.10 | 35.4 | 9.5 | 6.7 | — | 1.1 | — | — | — | — | — | — | Rest |
| 2 | 0.52 | 0.61 | 0.11 | 35.5 | 9.6 | 6.8 | — | 1.0 | — | — | — | — | — | — | Rest |
| 3 | 0.90 | 0.62 | 0.14 | 35.2 | 9.2 | 6.6 | — | 1.0 | — | — | — | — | — | — | Rest (Fe: 1.2) |
| 4 | 0.54 | 0.04 | 0.03 | 35.1 | 9.4 | 6.3 | — | 1.2 | — | — | — | — | — | — | Rest |
| 5 | 0.53 | 0.99 | 0.85 | 35.3 | 9.2 | 6.5 | — | 1.1 | — | — | — | — | — | — | Rest (Fe: 1.8) |
| 6 | 0.54 | 0.84 | — | 34.8 | 8.8 | 6.7 | — | 1.3 | — | — | — | — | — | — | Rest |
| 7 | 0.53 | — | 0.70 | 35.0 | 9.1 | 6.5 | — | 1.0 | — | — | — | — | — | — | Rest |

TABLE 1-continued

| Alloys | Proportions of the components (% by weight) | | | | | | | | | | | | | | |
|---|---|---|---|---|---|---|---|---|---|---|---|---|---|---|---|
| | C | Si | Mn | Cr | Ni | W | Mo | Hf | Al | Y | Ta | Nb | B | Zr | Co + impurities |
| 8 | 0.54 | 0.67 | 0.12 | 30.5 | 8.8 | 6.7 | — | 1.3 | — | — | — | — | — | — | Rest |
| 9 | 0.52 | 0.61 | 0.11 | 39.7 | 9.4 | 6.6 | — | 1.0 | — | — | — | — | — | — | Rest |
| 10 | 0.38 | 0.66 | 0.12 | 34.2 | 5.3 | 5.5 | — | 0.9 | — | — | — | — | — | — | Rest |
| 11 | 0.55 | 0.64 | 0.11 | 35.2 | 14.9 | 6.7 | — | 1.1 | — | — | — | — | — | — | Rest (Fe: 2.7) |
| 12 | 0.53 | 0.63 | 0.13 | 35.4 | 9.1 | 2.2 | — | 1.0 | — | — | — | — | — | — | Rest |
| 13 | 0.50 | 0.62 | 0.10 | 35.1 | 10.2 | 11.8 | — | 1.1 | — | — | — | — | — | — | Rest |
| 14 | 0.51 | 0.60 | 0.11 | 36.2 | 9.0 | — | 2.1 | 1.0 | — | — | — | — | — | — | Rest |
| 15 | 0.48 | 0.66 | 0.13 | 35.3 | 9.6 | — | 7.2 | 1.2 | — | — | — | — | — | — | Rest |
| 16 | 0.45 | 0.84 | — | 33.9 | 10.6 | — | 11.7 | 1.0 | — | — | — | — | — | — | Rest |
| 17 | 0.52 | 0.61 | 0.12 | 35.4 | 9.3 | 6.8 | — | 0.13 | — | — | — | — | — | — | Rest |
| 18 | 0.54 | 0.48 | 0.11 | 35.0 | 9.0 | 5.9 | — | 0.51 | — | — | — | — | — | — | Rest |
| 19 | 0.52 | 0.64 | 0.14 | 35.4 | 9.5 | 6.6 | — | 4.99 | — | — | — | — | — | — | Rest |
| 20 | 0.51 | 0.04 | 0.77 | 35.2 | 8.9 | 4.1 | 2.0 | 1.0 | 0.03 | — | — | — | — | — | Rest |
| 21 | 0.54 | 0.62 | 0.14 | 35.1 | 9.2 | 6.0 | — | 1.1 | — | 0.12 | — | — | — | — | Rest (Fe: 1.9) |
| 22 | 0.53 | 0.56 | 0.11 | 35.2 | 9.0 | 6.5 | — | 1.1 | 0.14 | 0.15 | — | — | — | — | Rest |
| 23 | 0.54 | 0.55 | 0.43 | 35.1 | 8.8 | 2.7 | 3.9 | 1.2 | 0.93 | — | — | — | — | — | Rest |
| 24 | 0.52 | 0.63 | 0.10 | 35.2 | 9.5 | 6.7 | — | 1.1 | — | — | 0.52 | — | — | — | Rest |
| 25 | 0.52 | — | 0.88 | 35.5 | 9.0 | 4.2 | 1.2 | 0.8 | 0.09 | — | 1.54 | — | — | — | Rest |
| 26 | 0.51 | 0.64 | 0.11 | 35.1 | 10.8 | 2.8 | 2.7 | 1.0 | — | — | — | 2.96 | — | — | Rest |
| 27 | 0.54 | 0.60 | 0.15 | 35.8 | 9.5 | 6.4 | — | 1.2 | — | — | 0.91 | 0.83 | — | — | Rest (Fe: 1.6) |
| 28 | 0.52 | 0.64 | 0.11 | 35.1 | 9.6 | 5.1 | 1.0 | 0.9 | — | — | — | — | 0.032 | — | Rest |
| 29 | 0.51 | — | 0.80 | 35.0 | 9.1 | — | 6.6 | 1.3 | — | 0.07 | — | — | — | 0.0053 | Rest |
| 30 | 0.51 | 0.64 | 0.14 | 35.8 | 9.0 | 3.2 | 1.8 | 1.1 | — | — | — | — | — | 0.0941 | Rest |
| 31 | 0.55 | 0.62 | 0.12 | 35.6 | 9.2 | 4.0 | 1.6 | 1.0 | 0.11 | — | — | — | 0.012 | 0.018 | Rest |
| 32 | 0.51 | 0.23 | 0.50 | 35.1 | 8.7 | 5.9 | — | 1.1 | — | — | 2.03 | — | 0.034 | — | Rest (Fe: 0.8) |
| 33 | 0.51 | 0.64 | 0.11 | 35.2 | 9.8 | — | 7.5 | 0.8 | — | — | — | 1.09 | 0.042 | 0.012 | Rest |
| 34 | 0.54 | 0.72 | — | 35.5 | 9.6 | 6.8 | — | 1.0 | 0.09 | — | 0.94 | — | 0.096 | — | Rest |
| 35 | 0.52 | 0.66 | 0.10 | 35.3 | 9.5 | 6.6 | — | 1.1 | — | 0.11 | 0.85 | 1.00 | 0.042 | — | Rest |
| 36 | 0.51 | 0.47 | 0.12 | 35.3 | 9.2 | 6.9 | — | 1.0 | 0.07 | 0.11 | 0.64 | 0.81 | 0.012 | 0.031 | Rest |
| Comparative Co-base heat resistant alloys | | | | | | | | | | | | | | | |
| 1 | 0.03 | 0.65 | 0.15 | 35.1 | 9.4 | 6.8 | — | 1.1 | — | — | — | — | — | — | Rest |
| 2 | 0.51 | 0.001* | 0.002* | 35.6 | 9.0 | 4.5 | 1.6 | 1.3 | 0.11 | — | — | — | — | — | Rest |
| 3 | 0.54 | 0.64 | — | 28.5* | 9.1 | — | 7.5 | 1.1 | — | — | — | — | — | — | Rest |
| 4 | 0.53 | 0.62 | 0.12 | 41.6* | 9.0 | 6.8 | — | 1.0 | — | | — | — | — | — | Rest |
| 5 | 0.54 | — | 0.54 | 35.2 | 3.2* | 7.0 | — | 0.9 | — | 0.08 | — | — | — | — | Rest |
| 6 | 0.52 | 0.64 | 0.11 | 35.3 | 9.3 | 1.6* | — | 1.1 | — | — | — | — | — | — | Rest |
| 7 | 0.51 | 0.63 | 0.09 | 35.5 | 9.7 | — | 1.4* | 1.0 | 0.12 | — | — | — | — | — | Rest |
| 8 | 0.53 | 0.55 | 0.14 | 35.8 | 9.0 | 0.8* | 0.9* | 1.1 | — | — | — | — | — | — | Rest |
| 9 | 0.55 | 0.66 | 0.08 | 35.6 | 9.4 | 13.8* | — | 1.1 | — | — | — | — | — | — | Rest |
| 10 | 0.49 | 0.65 | — | 35.4 | 9.3 | — | 13.1* | 1.2 | — | — | — | — | — | — | Rest |
| 11 | 0.50 | 0.64 | 0.12 | 35.5 | 9.2 | 6.6 | — | 0.08* | 0.07 | 0.05 | — | — | — | — | Rest |

TABLE 2

| Alloys | Mean rupture life (hr) | Weight reduction due to oxidation ($mg/cm^2$) | Rate of weight reduction due to corrosion (% by weight) | Alloys | Mean rupture life (hr) | Weight reduction due to oxidation ($mg/cm^2$) | Rate of weight reduction due to corrosion (% by weight) |
|---|---|---|---|---|---|---|---|
| Co-base heat resistant alloys of the present invention | | | | Co-base heat resistant alloys of the present invention | | | |
| 1 | 26.8 | 1.33 | 3.5 | 25 | 36.9 | 1.48 | 2.6 |
| 2 | 30.0 | 1.57 | 4.0 | 26 | 35.8 | 1.61 | 3.2 |
| 3 | 28.4 | 1.60 | 4.3 | 27 | 36.1 | 1.56 | 3.0 |
| 4 | 25.9 | 1.73 | 4.2 | 28 | 33.1 | 1.58 | 4.2 |
| 5 | 28.4 | 1.41 | 3.7 | 29 | 32.7 | 1.56 | 4.4 |
| 6 | 30.2 | 1.55 | 3.9 | 30 | 33.6 | 1.64 | 4.5 |
| 7 | 29.4 | 1.62 | 4.5 | 31 | 34.1 | 1.78 | 4.4 |
| 8 | 31.6 | 2.14 | 5.4 | 32 | 37.9 | 1.70 | 3.3 |
| 9 | 27.3 | 1.25 | 3.4 | 33 | 35.4 | 2.01 | 4.7 |
| 10 | 27.6 | 1.38 | 3.7 | 34 | 36.0 | 1.82 | 4.0 |
| 11 | 31.8 | 1.86 | 4.6 | 35 | 37.7 | 1.64 | 4.2 |
| 12 | 25.4 | 1.37 | 3.4 | 36 | 36.8 | 1.58 | 4.3 |
| | | | | Comparative Co-base heat resistant alloys | | | |
| 13 | 33.3 | 1.90 | 5.2 | 1 | 12.5 | 1.54 | 3.6 |
| 14 | 23.1 | 1.16 | 3.2 | 2 | 11.3 | 1.88 | 4.8 |
| 15 | 27.5 | 1.40 | 3.6 | 3 | 32.9 | 3.34 | 7.2 |
| 16 | 32.8 | 1.87 | 4.8 | 4 | 17.5 | 1.41 | 3.4 |
| 17 | 25.0 | 1.60 | 4.4 | 5 | 10.8 | 1.36 | 4.6 |
| 18 | 26.8 | 1.57 | 4.2 | 6 | 9.1 | 1.40 | 3.5 |
| 19 | 30.6 | 1.58 | 4.1 | 7 | 11.1 | 1.48 | 3.6 |
| 20 | 30.4 | 1.40 | 3.8 | 8 | 11.9 | 1.39 | 3.5 |
| 21 | 31.0 | 1.32 | 3.7 | 9 | 31.7 | 4.62 | 7.9 |
| 22 | 30.1 | 1.20 | 3.7 | 10 | 30.6 | 4.80 | 7.1 |
| 23 | 28.3 | 1.24 | 4.1 | 11 | 11.1 | 2.99 | 5.3 |
| 24 | 34.4 | 1.55 | 3.2 | | | | |

From the results shown in Table 2, it is evident that Co-base heat resistant alloys 1 to 36 of the present invention all have excellent high temperature strength, high temperature oxidation resistance and molten glass resistance. Whereas, comparative Co-base heat resistant alloys 1 to 11 with at least one of the components being outside the range according to the present invention (as identified by an asterisk * in Table 1) are inferior in at least one of the desired properties.

As described in the foregoing, the Co-base heat resistant alloys according to the present invention have excellent high temperature strength and high temperature oxidation resistance and they are also superior in the molten glass resistance. Therefore, these alloys are particularly useful as a material for an apparatus or equipment for treating molten glass. Particularly when the alloy of the present invention is used for a spinner for forming glass fibers, the spinner exhibits excellent performance for a long period of time. However, the present invention is not limited to this particular specific application, and is useful for the treatment of molten glass in general.

What is claimed is:

1. A Co-base heat resistant alloy consisting essentially of:

from 0.05 to 1% by weight of C, from 0.05 to 2% by weight of one or both of Si and Mn, from 35 to 40% by weight of Cr, from 5 to 15% by weight of Ni, from 2 to 12% by weight of one or both of W and Mo, from 0.1 to 5% by weight of Hf, the rest being Co and unavoidable impurities, with the proviso that iron may be present in amount of up to 3% by weight.

2. The Co-base heat resistant alloy according to claim 1, which further contains from 0.01 to 1% by weight of one or both of Al and Y.

3. The co-base heat resistant alloy according to claim 1, which further contains from 0.005 to 0.1% by weight of one or both of B and Zr.

4. The Co-base heat resistant alloy according to claim 1, which further contains from 0.01 to 1% by weight of one or both of Al and Y, and from 0.5 to 3% by weight of one or both of Ta and Nb.

5. The Co-base heat resistant alloy according to claim 1, which further contains from 0.01 to 1% by weight of one or both of Al and Y, and from 0.005 to 0.1% by weight of one or both of B and Zr.

6. The Co-base heat resistant alloy according to Claim 1, which further contains from 0.5 to 3% by weight of one or both of Ta and Nb, and from 0.005 to 0.1% by weight of one or both of B and Zr.

7. The Co-base heat resistant alloy according to Claim 1, which further contains from 0.01 to 1% by weight of one or both of Al and Y, from 0.5 to 3% by weight of one or both of Ta and Nb, and from 0.005 to 0.1% by weight of one or both of B and Zr.

8. A Co-base heat resistant alloy consisting essentially of:

from 0.05 to 1% by weight of C, from 0.05 to 2% by weight of one or both of Si and Mn, from 35 to 40% by weight of Cr, from 5 to 15% by weight of Ni, from 2 to 12% by weight of one or both of W and Mo, from 0.1 to 5% by weight of Hf, from 0.5 to 3% by weight of one or both of the Ta and Nb, the rest being Co and unavoidable impurities with the proviso that iron may be present in amount up to 3% by weight.

* * * * *